US005501050A

United States Patent [19]

Ruel

[11] Patent Number: 5,501,050

[45] Date of Patent: Mar. 26, 1996

[54] SHINGLED TILE BLOCK SIDING FACADE FOR BUILDINGS

[76] Inventor: Raymond Ruel, 54, Mgr. Bourget, Lévis, Québec, Canada, G6V 6R8

[21] Appl. No.: 499,463

[22] Filed: Jul. 7, 1995

Related U.S. Application Data

[63] Continuation-in-part of Ser. No. 136,943, Oct. 18, 1993, abandoned.

[51] Int. Cl.[6] ..... E04B 2/32

[52] U.S. Cl. ..... 52/513; 52/509; 52/283; 52/520; 52/546; 52/547; 52/553; 52/564; 52/597; 52/605; 52/506.09; 52/284; 52/379

[58] Field of Search ..... 52/509, 513, 283, 52/564, 520, 546, 547, 553, 597, 605, 506.09, 284, 379

[56] References Cited

U.S. PATENT DOCUMENTS

| | | | |
|---|---|---|---|
| 777,334 | 12/1904 | Dietrich | 52/283 |
| 939,762 | 11/1909 | Magdiel | 52/379 |
| 1,052,670 | 2/1913 | Francis | 52/509 |
| 1,334,599 | 3/1920 | Cusick | 52/541 |
| 1,982,560 | 11/1934 | Williams | 52/387 |
| 1,988,147 | 1/1935 | Voigt | 52/506.09 |
| 2,708,358 | 5/1955 | Schels | 52/541 |
| 3,015,193 | 1/1962 | Amoruso | 52/546 |
| 3,061,979 | 11/1962 | Roof | 52/477 |
| 3,888,055 | 6/1975 | Gallo | 52/283 X |
| 4,170,857 | 10/1979 | Rieger | 52/513 |

*Primary Examiner*—Carl D. Friedman
*Assistant Examiner*—Christopher Todd Kent
*Attorney, Agent, or Firm*—Francois Martineau; Pierre Lesperance

[57] ABSTRACT

The present facade wall consists of superposed courses of tile blocks which rest directly on the underlying tile blocks and which are maintained in front of a building wall with a predetermined gap by different types of clips. The several courses have a shingle lap with each other. The resulting facade is practically weatherproof and is easily erected. Each tile block has a peripheral groove for insertion of the clips and of interconnecting strips. This groove is in a plane parallel to the inside face of the block and nearer the latter than the outside face. The portions of the top and bottom edge faces of the block which are external to the groove constitute rest faces while the portion of the bottom edge face which is internal to the groove is recessed for free passage of the clips which do not support the load of the blocks.

1 Claim, 5 Drawing Sheets

SHINGLED TILE BLOCK SIDING FACADE FOR BUILDINGS

This is a Continuation-in-part application of patent application Ser. No. 08/136,943 filed on Oct. 18, 1993 now abandoned.

FIELD OF THE INVENTION

This invention relates to slabs of stone adapted to be mounted on the side of a building in the form of siding.

BACKGROUND OF THE INVENTION

U.S. Pat. No 1,982,560 issued in 1934 to the Rostone, Inc. corporation, discloses a clip system for both releasably interlocking a pair of superimposed concrete blocks as well as for releasably interlocking each given block to a vertical wall against which it is adapted to be applied. Three different embodiments of clips are envisioned to be used in this invention: clips 5, 7 and 8, as illustrated in FIGS. 5, 6 and 8 respectively of the drawings. Clip 5 defines a rectangular metal plate, having first and second long edges. Said first edge of each clip 5 is located outwardly relative to the wall 1, and defines a plurality of alternating, coplanar, upwardly and downwardly extending tongues **5*b* and 5*c* which extend orthogonally of the main body of the clip. Tongues 5*b* and 5*c* snugly engage into corresponding registering grooves b and c made on the bottom edge portion of an upper concrete block and on the top edge portion of an underlying lower concrete block, respectively. Therefore, relative horizontal play of the blocks is substantially prevented. Moreover, said second edge of each clip 5 defines an upturned elongated flange 5*a*, orthogonal to the main body of the clip 5. Flange 5*a* snugly engages into a pocket, under a wedge action behind a projecting ear 2 which is integral to the vertical wall 1, whereas horizontal motion of each block B relative to the wall 1 is substantially prevented. The generally cross-sectionally L-shape clip 7 is for use in securing the lowermost block B to the wall 1, as suggested in FIG. 7. Clip 8 is somewhat U-shape in cross-section, with a peg-like pointed leg on one side. It is further noted that the invention declares (column 2, lines 9–16) that he feels his invention is not limited to the use of such grooves b, c, in the concrete blocks and clips 5, 7 and 8**, whereas other "interengaging devices" to secure the blocks in place are envisioned not to be excluded from the scope of this invention —an all-encompassing claim that would appear far-fetched.

Canadian patent No 911,193 issued in October 1972 to the German company Max Langensiepen Kom. Gesellschaft, as well as Canadian patent No 274,045 issued in 1927 to J. F. Makowski, both disclose a clip similar to clip 5 of the Rostone patent,supra.

U.S. Pat. No. 4,170,857 issued on 16 Oct. 1979 to the Austrian company Bauhütte Leitl-Werke Rieger-Anlaggentechnik GmbH discloses a facade construction consisting of a number of superimposed blocks 2 and 3, which are interconnected to one another and to the supporting wall 8 by connecting means and applied against that upright wall 8. The connecting means includes: first vertical rods, 9, connected to the wall 8 by fasteners 9'; and second horizontal rods, 14, engaging complementary horizontal edgewise grooves 13, 13' in each pair of superimposed blocks 3 and being connected to the first rods 9. FIG. 3 suggests how the rods 9 and 14 would be interconnected. Moreover, there is shown in FIG. 7 an alternate block interconnecting means clip, defining a configuration having a first T-shape extension at one end and a second L-shape extension at the opposite end.

Canadian patent 1,057,928 issued on 10 Sep. 1979 to the United States Gypsum company, limited, further discloses in FIG. 3 a similar clip of H-shape.

Both U.S. Pat. No. 1,334,599 issued in 1920 to Wilfred CUSICK and U.S. Pat. No. 2,708,358 issued in 1955 to Carl SCHELS, show that it is well known to provide a building block with a downwardly projecting rib at its bottom outer edge, in order to outwardly overlap the upper edge of an underlying second block. Clearly, such overlapping ribs are directed at substantially preventing undesirable weathering of the edgewise joints between superimposed pairs of building blocks.

Canadian patent 1,057,928 discloses a clip for mounting a facing member spaced from a wall with the clip having upwardly and downwardly extending flanges which extend into recesses in the facing members.

OBJECTS OF THE INVENTION

The gist of the invention is therefore to improve upon existing facade assemblies for upright walls.

SUMMARY OF THE INVENTION

The facade wall of the invention comprises superposed courses of tile blocks the load of which is entirely supported by the building footing and which is disposed At a predetermined distance from the building wall by clip means, by bottom retaining rails and by junction strips. The clip means solely maintain the facade wall at a set distance from The building wall without supporting the load of the blocks. Each tile block defines an interior face, an exterior face, a top edge Face and a bottom edge face together with said edge faces which are normal to the interior face. The block is provided with a peripheral groove running through the top edge face, the bottom edge face and both side edge faces; this groove lies in a plane which is parallel to the interior face and which is nearer the latter than the external face of the grooved tile block. The portions of the top and bottom edge faces which are external to the groove form rest faces which directly abut each other. The portion of the bottom edge face which is internal to the groove is recessed with respect to the portion of the bottom edge face which is external to the groove. These recessed portions form a passage through which freely extends the clip attaching the tile blocks to the building wall. The external portion of the bottom edge face of the blocks of the lowermost course directly rest on the building footing.

Preferably, each said tile block is a slab of stone.

Preferably also, each tile block has a lower lip to form a shingle lap with the tile blocks of a lower course. The clip means include top clips to engage the tile blocks of the uppermost course, intermediate clips to engage the tile blocks of two superposed courses, and a bottom retaining rail to engage the groove of the blocks of the lowermost course. The clips are secured to the building wall while the rail is secured to the building footing. Junction strips are further provided to interconnect adjacent tile blocks of any given course. Each bottom retaining rail consists of a horizontal strip with an edgewisely upturned flange, said strip to be horizontally anchored to the footing of the building, said flange snugly engaging and releasably receiving the lower run of the grooves of a number of successive tile blocks of the lowermost course.

The upturned flange of the horizontal strip includes lengthwisely spaced notches, and each said junction strip vertically extends through side runs of the grooves of each pair of adjacent tile blocks of a given course, the junction strips of the lowermost course, releasably engaging at its bottom end a selected one of said notches.

Advantageously, each said intermediate clip defines a web with an upturned L-shape first end and a T-shape opposite second end, said L-shape first end to be anchored against said upright wall, said T-shape second end releasably engaging the lowermost run of the groove of a tile block and the upper run of the groove of an underlying tile block.

Preferably each said top clip defines a web with an upturned leg at one end and a downturned leg at the opposite end, said upturned leg to be anchored to said upright wall, said downturned leg releasably engaging into and securing the upper run of the groove of a tile block of the uppermost course.

DETAILED DESCRIPTION OF THE INVENTION

Figure 1:
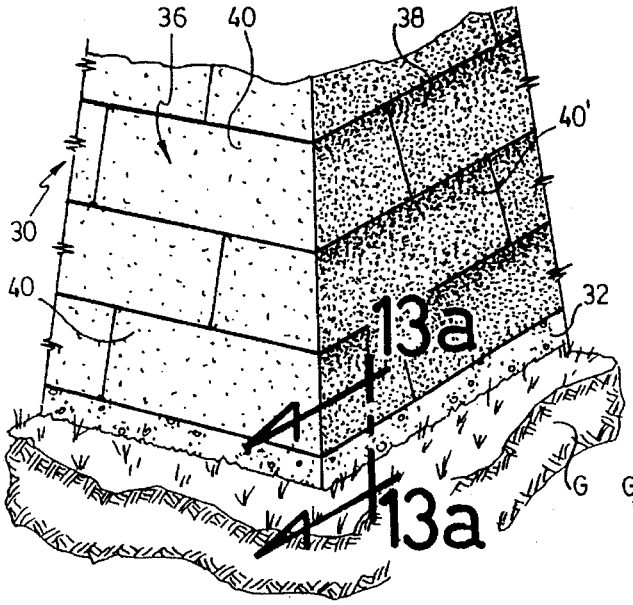
FIG. 1 is a perspective view of a first embodiment of wall portion made from stone slabs of the invention.
Figure 2:
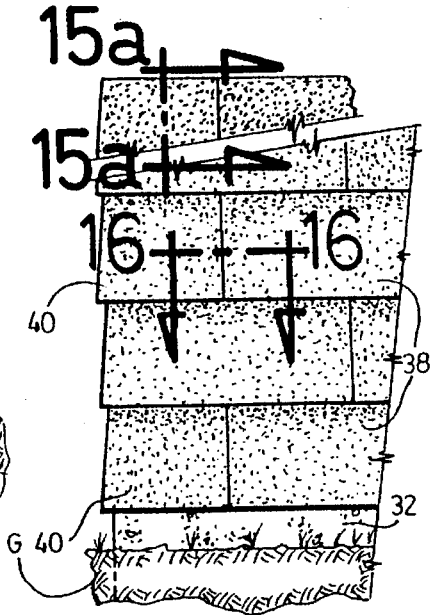
FIG. 2 is a partial, front elevational view of the wall portion of FIG. 1.
Figure 3:
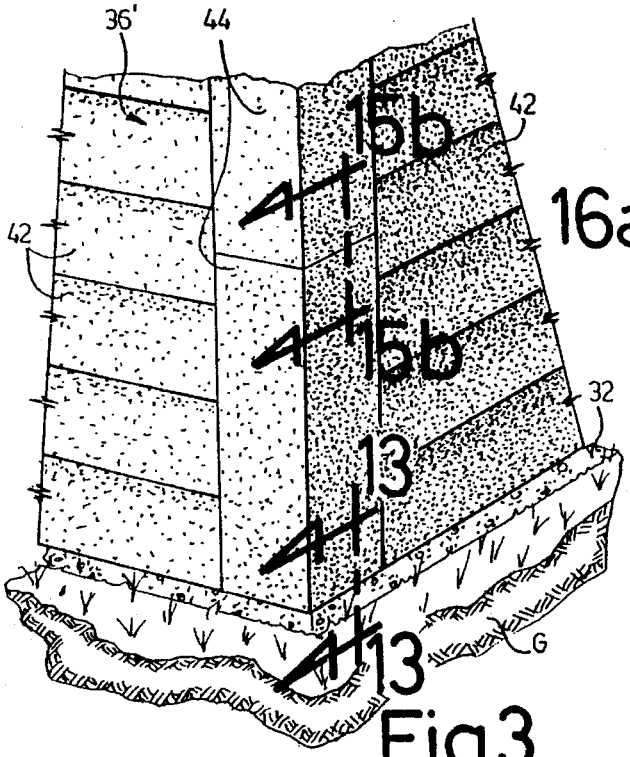
FIG. 3 is a perspective view of a second embodiment of wall portion made from stone slabs of the invention.
Figure 4:
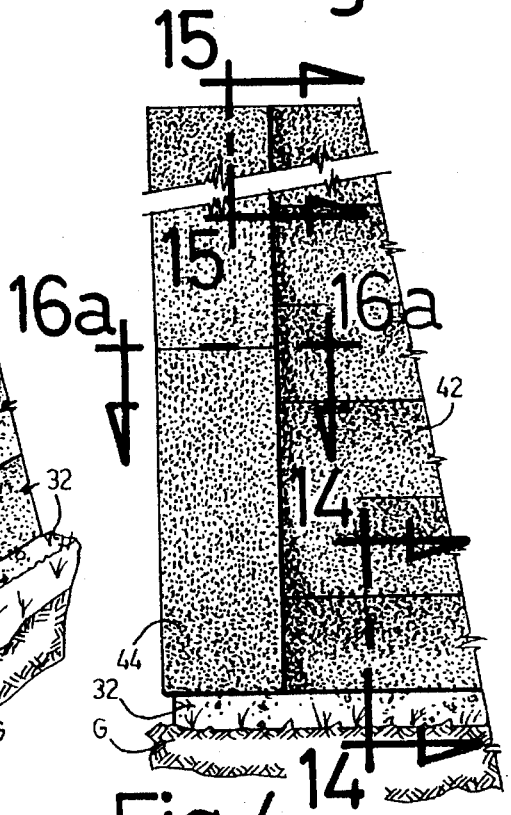
FIG. 4 is a partial, front elevational view of the wall portion of FIG. 3.
Figure 6:
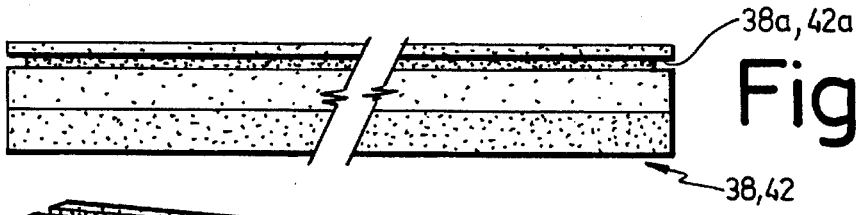
FIG. 6 is a long edge view of the rectangular stone slab of FIG. 5.
Figure 5:
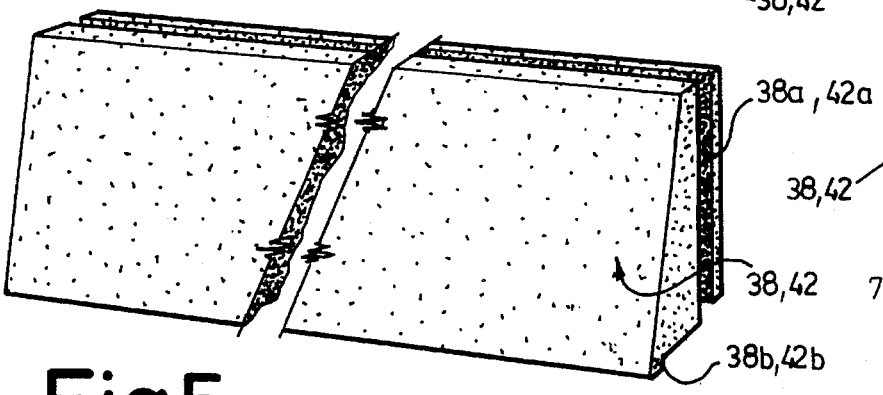
FIG. 5 is a broken, isometric view of a first embodiment of stone slab of the invention.
Figure 13:
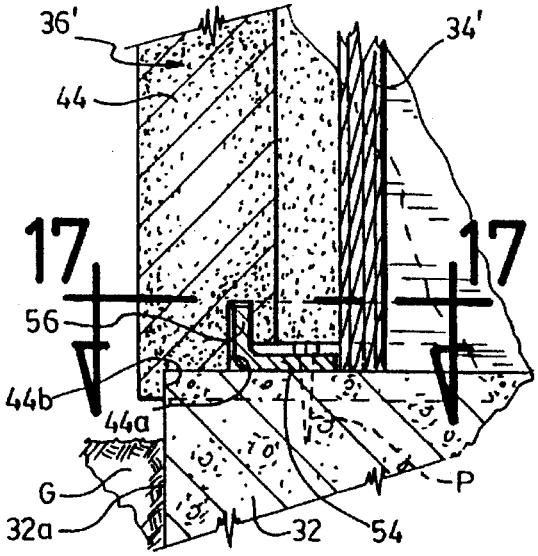
FIGS. 13 and 13*a* are enlarged cross-sectional views taken along lines 13—13 of FIG. 3 and 13*a*—13*a* of FIG. 1, respectively.
Figure 13A:
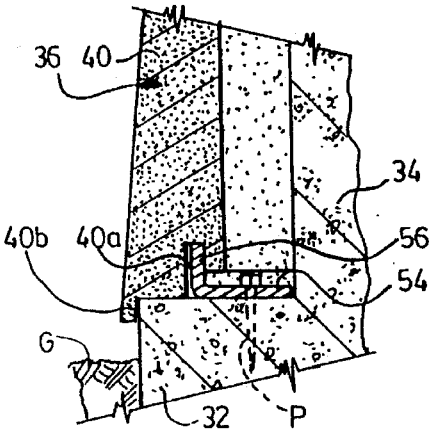

The ground standing building 30 (FIGS. 1 and 3) includes a footing or base 32, for example made in concrete, being embedded into ground G, and a wall 34' (FIGS. 13–13*a*) secured to base 32. A facade or siding assembly, 36 (or 36') is mounted against the exterior face of the wall 34' and rests on the forwardly protruding footing 32. FIGS. 1 and 3 show only a corner portion of building 30 fitted with the two embodiments of siding assemblies 36 and 36', respectively.

Facade or siding assembly 36 includes a first set of horizontally extending, elongated, straight block units namely tile blocks 38, and a second set of left- and right-angled, horizontally extending, cross-sectionally L-shape elongated block units 40, 40', respectively. The alternate mode of facade or siding assembly, 36', includes a first set of straight, horizontally extending, elongated block units, 42, and a second set of straight, vertically extending, cross-sectionally V-shape, elongated block units 44.

Figure 19:
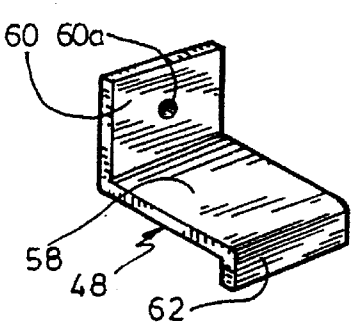
FIGS. 18–20 are perspective views of the three clips used for interconnecting the present stone slabs.
Figure 18:
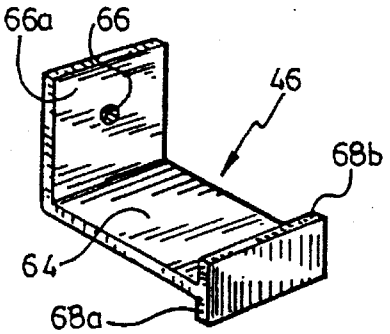
Figure 20:
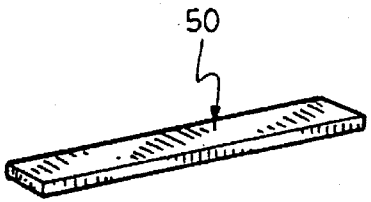
Figure 21:
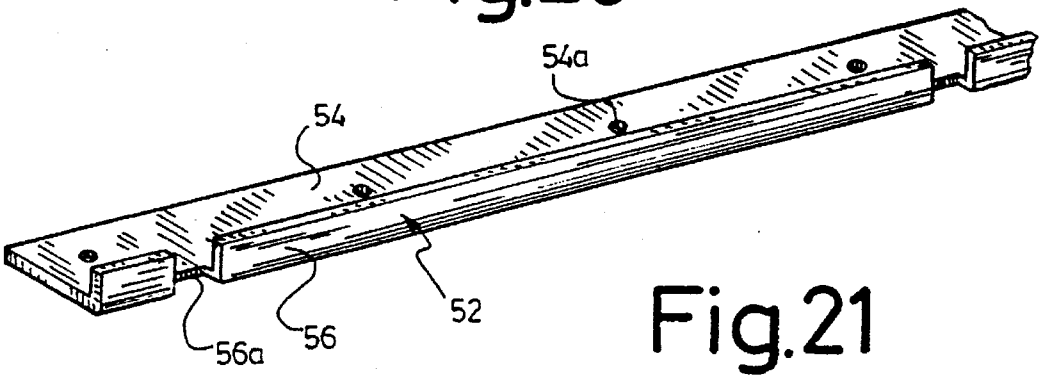
FIG. 21 is a perspective view of the corner plate from FIG. 17, for anchoring the slabs at the wall corner portion illustrated in FIGS. 3 and 4.

Tile blocks 38–44 are connected to wall 34' by a number of top clips 48 and intermediate clips 46. Bottom retaining rails 52 secure the lowermost course of tile blocks to footing 32. Junction strips 52 interconnect the tile blocks of any given course (FIGS. 18 to 20).

Block units 38 and 40, 40', sharing each horizontal row or course of the facade assembly of FIG. 1, should be of substantially the same height, to ensure joints of constant resistance with the overlying as well as underlying rows of tile blocks. Similarly, tile blocks 42 should all be of substantially constant height.

As suggested in FIGS. 5–12, each tile block 38 or 42 includes a peripheral edgewise groove 38*a*–44*a*, respectively, extending between the flat exterior and interior faces thereof, and a downwardly projecting rib 38*b*–44*b*, respectively, located at the bottom edge portion of the exterior face thereof. Each block unit 38–42 tapers upwardly on its portion located exteriorly relative to the rib 38*b*–42*b*. Grooves 38*a*–44*a* are for engagement by the connector clip members 46, 48, junction strips 50 and rail 52, detailed below. Ribs 38*b*–42*b* form lap joints between superimposed pairs of tile blocks as a weather protection.

Preferably, tile blocks 38–44 are made from stone.

Referring to FIGS. 13, 13*a*, 17 and 21, there is illustrated how the bottom retaining rail 52 releasably secures the lowermost row of tile blocks 40 and 44 to the building concrete base 32. Rail 52 has an L-shape cross-section defining a base flange 54 and an upturned flange 56. Flange 56 include a number of lengthwisely spaced notches 56*a*. Base flange 54 is laid flat against the top flat face of concrete footing 32, with upturned flange 56 directed exteriorly slightly short of the exterior edge 32*a* of footing 32. Base flange 54 is anchored to footing 32 by pegs P driven thereinto through bores 54*a*. Flanges 56 snugly engage into the horizontal lower section of the edgewise grooves 40*a*, 44*a*, of corresponding tile blocks 40, 44, respectively.

Accordingly, rail 52 maintains the tile blocks 40, 44 of the lowermost course at a set distance from wall 34' but do not support these tile blocks. Each notch 56*a* in flange 56 is in turn engaged by the bottom end of an upright, straight, rectangular junction strip 50 (FIG. 20).

Figure 15:
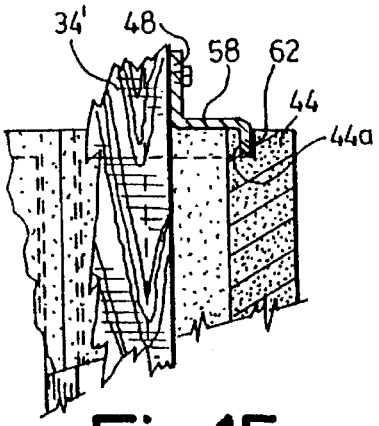
Figure 15A:
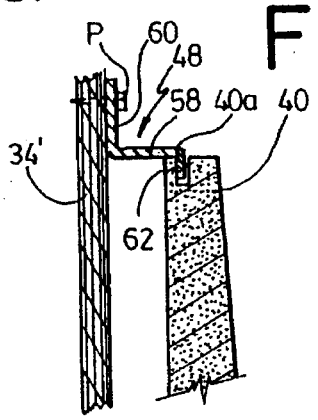
FIG. 15*a* is an enlarged cross-section about line 15*a*—15*a* of FIG. 2.
Figure 15B:
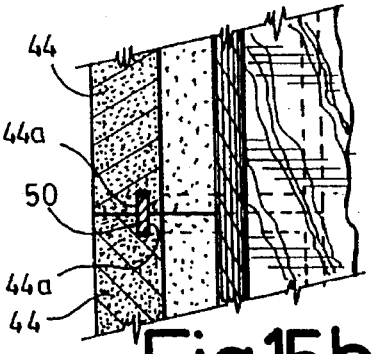
FIG. 15*b* is an enlarged cross-section about line 15*b*—15*b* of FIG. 3.
Figure 16:
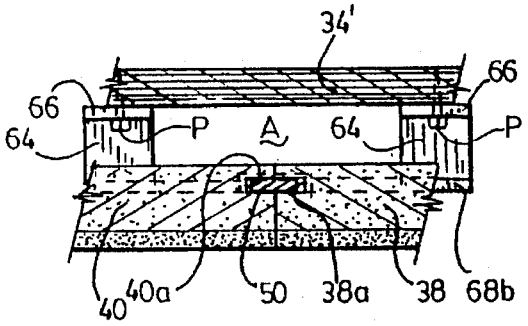
FIGS. 16 and 16*a* are enlarged cross-sections taken along lines 16—16 of FIG. 2 and 16*a*—16*a* of FIG. 4, respectively.
Figure 16A:
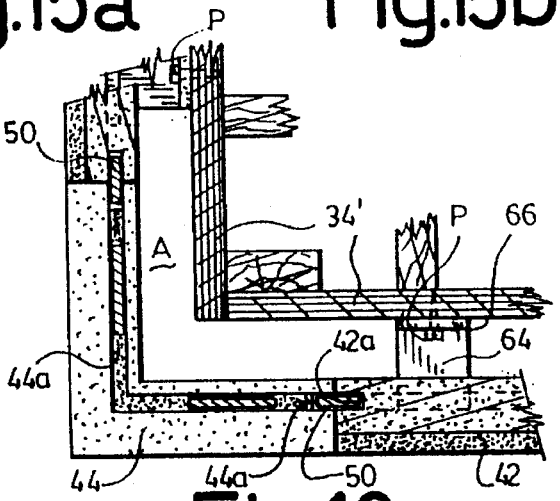
Figure 17:
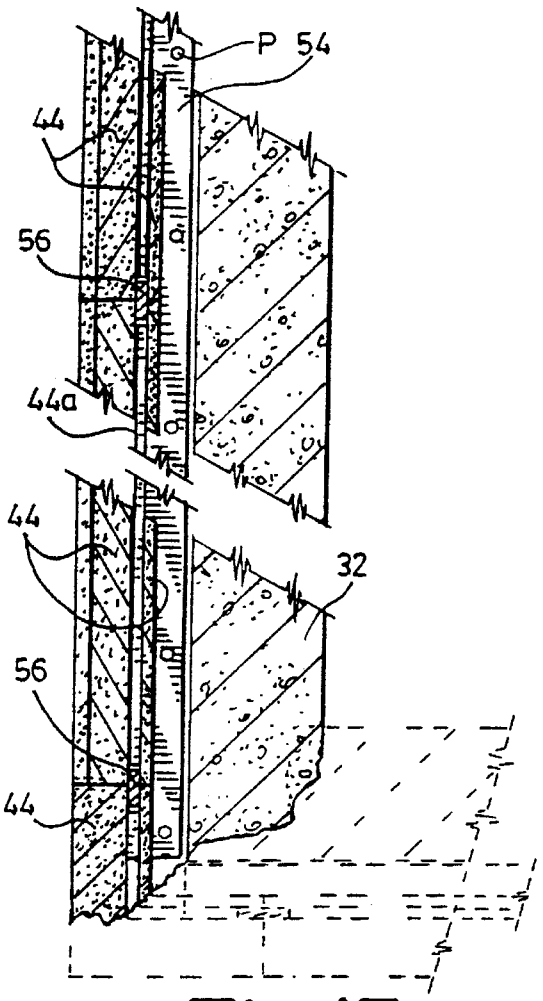
FIG. 17 is a sectional view along line 17—17 of FIG. 13.

As suggested in FIGS. 15*b*, 16*b* and 17, junction strip 50 extends through and is sized to fit the two facing grooves of the vertical side portions of any pair of adjacent tile blocks 38–44 of a given course. For example, in FIG. 16, registering grooves 38*a*, 40*a*, from tile block 38, 40, form a single vertical channel through which vertically extends the flat rectangular strip 50. Accordingly, junction strips 50 positively maintain successive pair of tile blocks 38 and 40 in substantially coplanar fashion in any given course.

Referring now to FIGS. 15, 15*a* and 19, there is shown how the uppermost course or row of tile blocks are releasably connected to wall extension 34' of the building 30 to be facaded, to prevent the falling down of the tile blocks. Top clip 48 defines a quadrangular plate 58 with a long upturned flange 60 at one edge thereof and a short downturned flange 62 at the opposite edge thereof. Flange 60 includes a central bore 60*a*. Hence, flange 60 is applied flatly against wall 34' of the building, slightly above the uppermost row of block units, and anchored thereagainst by a peg P driven thereinto through bore 60*a*. The exteriorly downwardly oriented flange 62 snugly engages the top run of the groove 44*a* (in FIG. 15) or 40*a* (in FIG. 15*a*) of the uppermost row of tile blocks 44 or 40 respectively.

Figure 14:
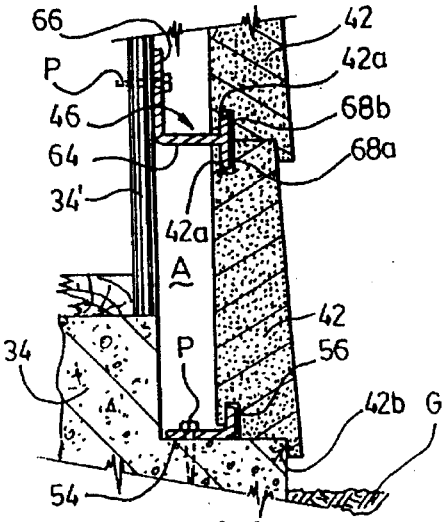
FIGS. 14 and 15 are enlarged cross-sections about lines 14—14 and 15—15 respectively of FIG. 4.

We will now refer to FIGS. 14 and 18 of the drawings. Intermediate clip 46 is similar to top clip 48, with a quadranguular flat web 64, a rear upturned flange 66 with associated through-bore 66*a*, and a front downturned flange 68*a;* but clip 46 further includes an upturned flange 68*b* coextensive with downturned flange 68*a*. Flat flange 66 is applied flatly against the building wall 34' and anchored thereto by driving a peg P thereinto through bore 66*a*. Flanges 66*a*, 68*a* are made to engage the horizontal channel made by the two registering grooves 42*a*, 42*a* (in FIG. 14) defined by the lower edge of an overlying tile block 42 and the upper edge of an underlying tile block 42; whereby successive pairs of superimposed tile blocks are positively maintained in coplanar fashion.

Rail 52 and clips 46 and 48 constitute spacer means that define and maintain a gap A between wall 34' and facade 36. Gap A desirably promotes air ventilation therebetween.

Figure 7:
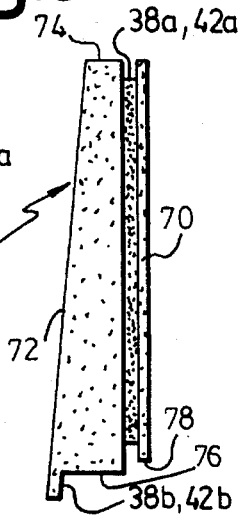
FIG. 7 is a short edge view of the rectangular stone slab of FIG. 5.
Figure 8:
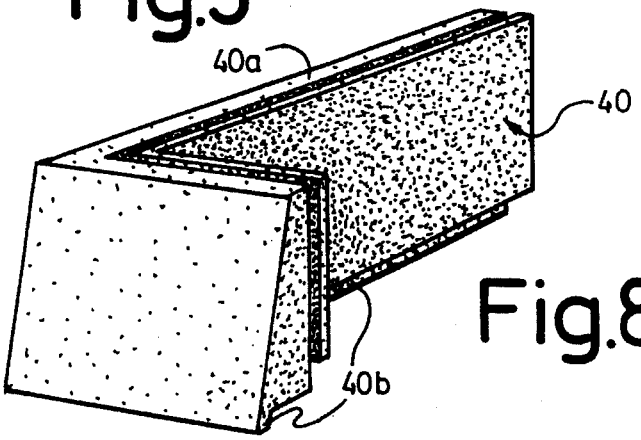
FIGS. 8–8*a* are perspective views, from opposite sides, of a second embodiment of stone slab.
Figure 8A:
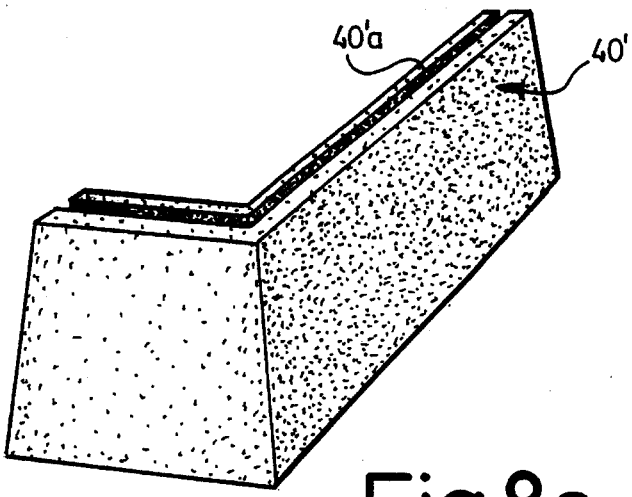
Figure 9:
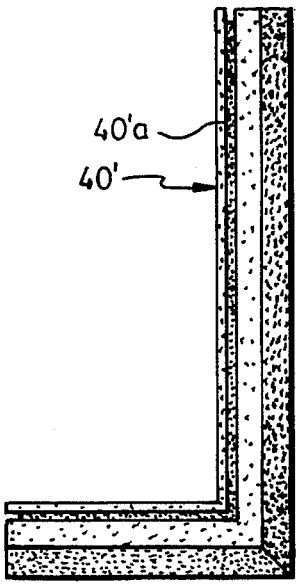
FIG. 9 is a long edge view of the slab of FIGS. 8–8*a;*
Figure 10:
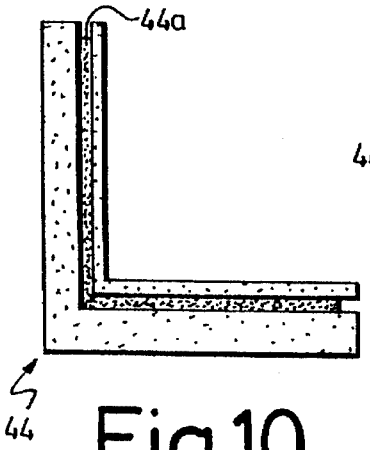
FIG. 10 an end view of a third embodiment of stone slab.
Figure 11:
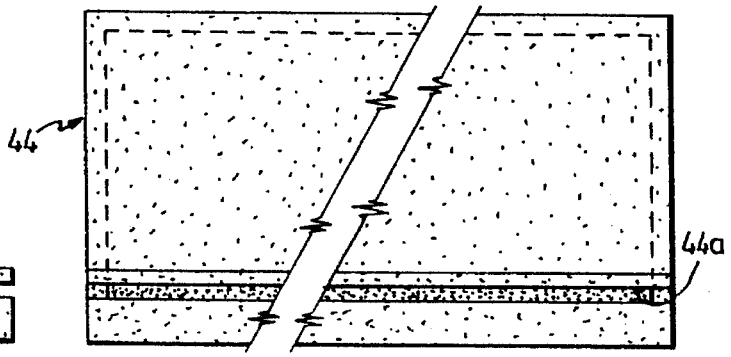
FIG. 11 is a broken front elevation of the slab of FIG. 10.
Figure 11A:
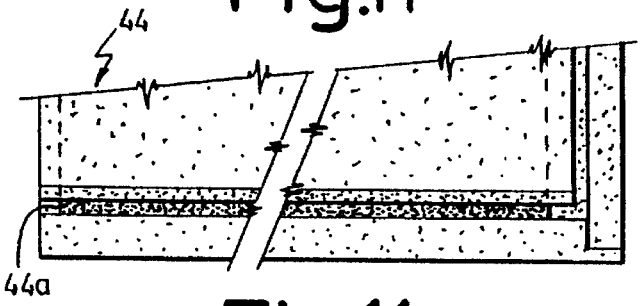
FIG. 11*a* is a broken rear elevation of the slab of FIG. 10.
Figure 12:
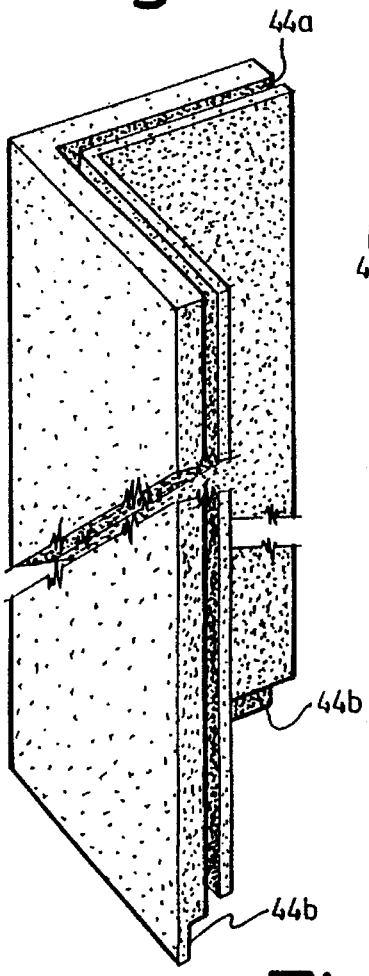
FIG. 12 is a perspective view of the slab of FIG. 10.

Referring to FIGS. 7 and 14, peripheral groove 38*a*, 42*a* of tile block 38, 42 is parallel to block interior face 70 and nearer face 70 than block exterior face 72. The portion 74 of the block top edge face which is external to groove 38*a*, 42*a* directly abuts against portion 76 of the block bottom edge face which is external to groove 38*a*, 42*a*. The portion 78 of the block bottom edge face which is internal to groove 38*a*, 42*a* is recessed relative to external bottom edge face portion 76. It follows that the load of facade 36 is directly supported by footing 32 while the clips 46, 48 and bottom rail 52 together with junction strips 50 serve only to prevent tilting of the wall and to maintain gap A.

I claim:

1. A building comprising a building wall, a footing protruding from said building wall and a facade consisting of several tile blocks arranged in vertically superposed horizontal courses at a predetermined distance from said building wall, the blocks of the lowermost course directly supported by said footing, the blocks of an underlying course directly supporting the blocks of an overlying course, each tile block made of solid material and having a flat top edge face, a bottom edge face parallel to said top edge face, a pair of flat parallel side edge faces normal to said top and bottom edge faces, a flat exterior face and a flat interior face, said interior face normal to said edge faces, said exterior face downwardly diverging relative to said interior face, a lip downwardly protruding from said bottom edge face and forming a lower extension of said exterior face, each tile block further having a peripheral, continuous groove formed in said top, bottom and side edge faces, said groove coplanar with said interior face and nearer said interior face than said exterior face, said bottom edge face defining an external, flat, bottom edge face portion extending from said lip to said groove and an internal, flat, bottom edge face portion extending from said groove to said interior face and recessed relative to said external bottom edge face portion, the lips of the tile blocks of an overlying course forming a shingle lap with the tile blocks of an underlying course, the tile blocks of the lowermost course resting directly on said footing by direct supporting engagement of their external bottom edge face portion with said footing and with their lip forming a shingle lap with said footing, the external bottom edge face portion of the tile blocks of said courses except said lowermost course resting directly on the top edge face of the tile blocks of an underlying course, the internal bottom edge face portions of the tile blocks of all said courses defining a clip passage with said footing and with the top edge face of the tile blocks of an underlying course, and clips to secure said facade in front of said building wall, each clip having a web normal to said building wall and freely extending through one of said passages and an inturned flange freely engaging said groove of said top and bottom edge faces and further including flat strips engaging said grooves at said side edge faces of two adjacent tile blocks of the same course, said clips and flat strips maintaining said facade at a set distance from said building wall without supporting the load of said blocks, said load being entirely supported by said footing.

* * * * *